US009682808B2

(12) United States Patent
Apps

(10) Patent No.: US 9,682,808 B2
(45) **Date of Patent: *Jun. 20, 2017**

(54) STACKABLE LOW DEPTH TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 621 days.

This patent is subject to a terminal disclaimer.

(21) Appl. No.: 12/468,281

(22) Filed: May 19, 2009

(65) Prior Publication Data

US 2009/0223854 A1 Sep. 10, 2009

Related U.S. Application Data

(63) Continuation of application No. 11/389,832, filed on Mar. 27, 2006, now Pat. No. 7,549,539, which is a (Continued)

(51) Int. Cl.

| | |
|---|---|
| ***B65D 21/032*** | (2006.01) |
| ***B65D 71/70*** | (2006.01) |
| ***B65D 1/24*** | (2006.01) |

(52) U.S. Cl.

CPC ..... *B65D 71/70* (2013.01); *B65D 1/243* (2013.01); *B65D 2501/24019* (2013.01); (Continued)

(58) Field of Classification Search

USPC ..... 220/770, 519, 517, 516, 513, 509; 206/509, 511

See application file for complete search history.

(56) References Cited

U.S. PATENT DOCUMENTS

| | | | |
|---|---|---|---|
| 820,445 | A | 5/1906 | Speer |
| D103,862 | S | 3/1937 | Randall et al. |

(Continued)

FOREIGN PATENT DOCUMENTS

| | | |
|---|---|---|
| BE | 680197 | 10/1966 |
| BE | 693216 | 7/1967 |

(Continued)

OTHER PUBLICATIONS

Exhibit 1: Four photos of a prior art case of Rehrig Pacific Company, Model No. PLBC-8-2L-PET-QD (1984).

(Continued)

*Primary Examiner* — Stephen Castellano

(74) *Attorney, Agent, or Firm* — Carlson, Gaskey & Olds PC

(57) ABSTRACT

A low depth tray for bottles is provided which includes a first pair of opposed walls, a second pair of opposed walls attached to the first pair of opposed walls to form a wall structure, and a base attached to the wall structure. At least one interior column projects upwardly within the wall structure, where the interior column has a height less than the height of bottles loaded in the tray. A plurality of interior divider walls of double-walled construction project upwardly from the base and extend between the one or more interior columns and the wall structure. Together, the divider walls, interior columns, base, and outer wall structure define a plurality of bottle retaining pockets, where each pocket includes at least one divider wall and is sized to receive a single bottle therein.

2 Claims, 14 Drawing Sheets

Related U.S. Application Data continuation of application No. 09/836,045, filed on Apr. 16, 2001, now Pat. No. 7,017,746.

(52) U.S. Cl.
CPC ..... *B65D 2501/2435* (2013.01); *B65D 2501/24108* (2013.01); *B65D 2501/24127* (2013.01); *B65D 2501/24152* (2013.01); *B65D 2501/24222* (2013.01); *B65D 2501/24254* (2013.01); *B65D 2501/24509* (2013.01); *B65D 2501/24687* (2013.01)

(56) References Cited

U.S. PATENT DOCUMENTS 2,411,673 A 11/1946 Vechey, Jr.
D147,981 S 11/1947 Lehman
D152,907 S 3/1949 Richards
2,512,855 A 6/1950 Erickson
2,526,335 A 10/1950 Deichert
2,530,481 A 11/1950 Rawn, Jr.
2,535,493 A 12/1950 Gerber
2,588,805 A 3/1952 Cross
2,626,079 A 1/1953 Keller
D172,664 S 7/1954 Emery
2,743,030 A 4/1956 Read, Jr.
2,840,256 A 6/1958 Cobb, Jr.
2,928,530 A 3/1960 Sauey
2,935,222 A 5/1960 O'Connell
2,970,715 A 2/1961 Kappel et al.
D189,891 S 3/1961 Schilling et al.
2,974,819 A 3/1961 Melville
2,979,222 A 4/1961 Levine
3,009,579 A 11/1961 Ettlinger, Jr.
3,055,531 A 9/1962 De Chelbor
3,055,542 A 9/1962 Russo
3,092,284 A 6/1963 Stout
D195,702 S 7/1963 Russo
3,148,797 A 9/1964 Cloyd
3,151,762 A 10/1964 Vidal
3,155,268 A 11/1964 Fogerty et al.
3,184,148 A 5/1965 Poupitch
D201,257 S 6/1965 Vidal
3,247,996 A 4/1966 Garcia
3,283,947 A 11/1966 Cornelius
3,297,190 A 1/1967 Cloyd
D208,111 S 7/1967 Vidal
3,332,574 A 7/1967 Earp
3,333,727 A 8/1967 Belcher et al.
3,333,729 A 8/1967 Rabb
3,334,767 A 8/1967 Cornelius et al.
3,349,943 A 10/1967 Box
D209,864 S 1/1968 Versteeg et al.
3,376,998 A 4/1968 Cornelius
3,384,261 A 5/1968 Austin
3,390,801 A 7/1968 Adomat
3,391,814 A 7/1968 Box
3,391,815 A 7/1968 Box
3,392,869 A 7/1968 Needt
3,416,694 A 12/1968 Bebb
3,428,207 A 2/1969 Schoeller
3,517,852 A 6/1970 Schoeller
3,638,824 A 2/1972 Sekiguchi et al.
3,638,827 A 2/1972 Lau, Jr. et al.
3,701,449 A 10/1972 Schoeller
3,759,416 A 9/1973 Constantine
D229,674 S 12/1973 Quigg
3,812,996 A 5/1974 Bunnell
3,865,239 A 2/1975 Herolzer et al.
3,949,876 A 4/1976 Bridges et al.
3,998,327 A 12/1976 Box
4,027,796 A 6/1977 Martin
4,037,722 A 7/1977 Bremer
4,040,517 A 8/1977 Torokvei
4,071,162 A 1/1978 Steinlein et al.
4,095,720 A 6/1978 Delbrouck et al.
4,101,049 A 7/1978 Wallace et al.
4,161,259 A 7/1979 Palafox
4,162,738 A 7/1979 Wright
4,202,448 A 5/1980 Jaeger et al.
4,204,596 A 5/1980 Davis
4,319,685 A 3/1982 David
4,344,530 A 8/1982 deLarosiere
D266,709 S 10/1982 Box
4,410,099 A 10/1983 deLarosiere
4,416,373 A 11/1983 deLarosiere
D275,142 S 8/1984 Torokvei
4,538,742 A 9/1985 Prodel
4,548,320 A 10/1985 Box
D283,103 S 3/1986 Cushing et al.
D284,841 S 7/1986 Rowland et al.
D289,938 S 5/1987 Warwick
D291,178 S 8/1987 Toms
4,700,836 A 10/1987 Hammett
4,700,837 A 10/1987 Hammett
D295,107 S 4/1988 Frost
4,773,554 A 9/1988 Warwick
4,789,063 A 12/1988 Hammett
4,848,580 A 7/1989 Wise
D304,123 S 10/1989 Warwick
4,899,874 A * 2/1990 Apps et al. ..... 206/201
4,911,303 A 3/1990 Andersson
4,928,841 A 5/1990 Arthurs
4,978,002 A 12/1990 Apps et al.
D313,493 S 1/1991 Apps et al.
D317,670 S 6/1991 Apps
D318,552 S 7/1991 Apps
5,031,774 A 7/1991 Morris et al.
D319,129 S 8/1991 Apps et al.
D320,298 S 9/1991 Apps et al.
5,060,819 A 10/1991 Apps
5,071,026 A 12/1991 Apps
5,096,085 A 3/1992 Eek et al.
D325,279 S 4/1992 Apps
5,105,948 A 4/1992 Morris et al.
D326,749 S 6/1992 Apps et al.
D327,357 S 6/1992 Rehrig
D327,972 S 7/1992 Apps et al.
D329,931 S 9/1992 Apps
D329,932 S 9/1992 Apps
5,184,748 A 2/1993 Apps
5,316,172 A 5/1994 Apps et al.
5,335,814 A 8/1994 Hepp
D350,438 S 9/1994 Apps et al.
5,421,477 A 6/1995 Hammett
D360,758 S 8/1995 Umiker
D361,431 S 8/1995 Koefelda
5,465,843 A 11/1995 Koefelda
5,487,487 A 1/1996 Hammett
5,501,352 A 3/1996 Apps
5,529,176 A 6/1996 Apps et al.
D378,249 S 3/1997 Apps et al.
D379,121 S 5/1997 Apps et al.
D379,717 S 6/1997 Apps et al.
D380,613 S 7/1997 Apps et al.
D380,901 S 7/1997 Apps et al.
5,651,461 A 7/1997 Apps et al.
5,660,279 A 8/1997 Apps et al.
5,704,482 A 1/1998 Apps et al.
D399,060 S 10/1998 Apps et al.
D400,012 S 10/1998 Apps
5,823,376 A 10/1998 McGrath
5,842,572 A 12/1998 Apps et al.
D404,204 S 1/1999 Apps
5,855,277 A 1/1999 Apps et al.
D410,778 S 6/1999 Apps et al.
5,913,424 A * 6/1999 Kelly et al. ..... 206/509
D412,399 S 8/1999 Apps et al.
5,964,343 A 10/1999 Steiner
5,979,654 A 11/1999 Apps
D417,784 S 12/1999 Umiker
6,006,912 A 12/1999 McGrath
D420,220 S 2/2000 Apps et al.
6,047,844 A 4/2000 McGrath

(56) References Cited

U.S. PATENT DOCUMENTS

| | | | | |
|---|---|---|---|---|
| 6,073,793 | A | 6/2000 | Apps et al. | |
| 6,079,554 | A | 6/2000 | Hammett et al. | |
| D465,417 | S | 11/2002 | Apps | |
| D485,756 | S | 1/2004 | Apps | |
| 7,017,746 | B2 | 3/2006 | Apps | |
| 7,549,539 | B2 * | 6/2009 | Apps | 206/509 |
| 2009/0242568 | A1 * | 10/2009 | Apps | 220/516 |
| 2010/0084297 | A1 * | 4/2010 | Apps | 206/427 |
| 2010/0084302 | A1 * | 4/2010 | Apps | 206/503 |

FOREIGN PATENT DOCUMENTS

| | | |
|---|---|---|
| CA | 965056 | 3/1975 |
| CA | 1109433 | 9/1981 |
| DE | 1207268 | 12/1965 |
| DE | 76 04 456 U1 | 6/1976 |
| DE | 94 20 125 U1 | 2/1995 |
| EP | 0099827 | 10/1986 |
| EP | 0210712 | 8/1990 |
| EP | 0 785 135 A | 7/1997 |
| EP | 1008527 | 6/2000 |
| FR | 1285689 | 1/1962 |
| FR | 1350962 | 12/1963 |
| FR | 1351218 | 12/1963 |
| FR | 1518610 | 2/1968 |
| FR | 2302244 | 9/1976 |
| GB | 943947 | 12/1963 |
| GB | 1032916 | 6/1966 |
| GB | 1115343 | 5/1968 |
| GB | 1120067 | 7/1968 |
| GB | 1152038 | 5/1969 |
| GB | 1312701 | 4/1973 |
| GB | 1319726 | 6/1973 |
| GB | 1330778 | 9/1973 |
| GB | 2079256 | 1/1982 |
| GB | 2135278 | 8/1984 |
| GB | 2158044 | 11/1985 |
| NE | 6505562 | 10/1966 |
| WO | 82/01536 | 5/1982 |
| WO | 98/07636 | 2/1998 |
| WO | 00/41937 | 7/2000 |

OTHER PUBLICATIONS

Exhibit 2: Two photos of a prior art case of Rehrig Pacific Company for 3 liter PET bottles (1990).

Exhibit 3: Two photos of a prior art case of D.W. Plastics (Date unknown).

Exhibit 4: Two photos of a prior art case of International Container Systems, Inc. for 3 liter PET bottles (Date unknown).

European Office Action for EP Application No. 02762006.1, Oct. 15, 2010.

* cited by examiner

STACKABLE LOW DEPTH TRAY

REFERENCE TO RELATED APPLICATIONS

This application is a Continuation patent application of U.S. patent application Ser. No. 11/389,832 filed Mar. 27, 2006, now U.S. Pat. No. 7,549,539 issued Jun. 23, 2009, which is a Continuation patent application of U.S. patent application Ser. No. 09/836,045 filed Apr. 16, 2001, now U.S. Pat. No. 7,017,746 issued Mar. 28, 2006.

BACKGROUND OF THE INVENTION

1. Field of the Invention

This invention relates to a stackable low depth tray for storing and transporting beverage containers, such as bottles.

2. Background Art

Bottles, particularly for soft drinks and other beverages, are often stored and transported in trays. The term "tray" as used herein includes trays, crates, cases, and similar containers having a floor and a peripheral side wall structure. As compared with other materials, plastic trays provide advantages such as strength, durability, and reusability. In order to minimize the storage space of trays, reduce their cost and weight, and promote display of the bottles contained therein, many trays are constructed to have shallow side and end walls. Such trays are generally referred to as "low depth" trays in which the side and end walls are lower than the height of the stored bottles, and in which the bottles support the weight of additional trays stacked on top.

In general, bottles go through a bottling facility and to the bottler's warehouse in the following order: the bottles are filled, sealed, loaded into trays, and then layers of trays are placed on pallets. Trays in successive layers are stacked or cross-stacked on top of each other, with the bottles bearing most of the load of above-stacked trays. The stacks of trays must be particularly stable in order to remain standing during the jostling inherent when the pallets are moved into and out of the warehouse.

Plastic bottles are widely used as containers for retailing soft drinks and other beverages. One type of plastic, polyethylene terephthalate (PET), has become particularly popular because of its transparency, light weight, and low cost. In addition to being flexible, the walls of PET bottles are strong in tension and thus can safely contain the pressure of a carbonated beverage. Moreover, conventional PET bottles can bear relatively high compressive loads, provided that the load is directed substantially along an axially symmetric axis of the bottle. A single PET bottle can support the weight of many bottles of the same size filled with beverage if the bottle is standing upright on a flat, horizontal surface and the weight of the other bottles is applied to the closure of the single bottle and is directed substantially vertically along its symmetric axis. However, if a compressive load is applied to a conventional PET beverage bottle along a direction other than the symmetry axis of the bottle, the bottle may buckle, particularly for large capacity bottles such as the two-liter bottle widely used for marketing soft drinks.

Bottles can also tilt away from vertical alignment upon stacking if conventional partitioned trays having low side walls are used to contain the bottles. Tilted bottles in the lower trays of a stack can buckle, causing the stack to fall. Even absent buckling, the tendency of bottles to tilt in conventional low-sided trays causes instability and places an undesirably low limit on the number of tiers that can be included in a stack.

With the aforementioned issues regarding bottle stability and storage and handling processes in mind, there are several features which are desirable for the design of low depth bottle trays. Generally, low depth trays should have a wall structure that provides sufficient support for the bottles stored therein while also allowing the bottles to be visible for merchandising purposes. In addition, trays should be designed with structural features which enhance their stability when stacked and cross-stacked. Still further, the wall structure should have sufficient strength and rigidity to withstand handling. Lastly, the trays should be lightweight and be easy to manipulate and carry.

While some trays may partially fulfill these objectives, two important problems are encountered with current low depth trays. First, low depth trays are typically designed with a trade off between side wall strength, weight, and the degree of visibility available for the bottles stored within the tray. Second, the wall structure of current trays often requires a snug fit between the bottle pocket and the bottle to ensure stability, which limits the range of bottle diameters which can be retained in a stable stack.

SUMMARY OF THE INVENTION

Therefore, it is an object according to the present invention to provide an improved low depth tray for storing, transporting, and displaying beverage containers, such as bottles.

It is another object according to the present invention to provide a low depth tray for bottles that is structured for high strength as well as high visibility of the bottles contained therein.

It is yet another object according to the present invention to provide a low depth tray for bottles that provides greater support and stability of the bottles loaded in the tray.

It is another object according to the present invention to provide a low depth tray for bottles which is lightweight and easy to handle.

It is another object according to the present invention to provide a low depth tray for bottles that is easier and less expensive to manufacture.

Accordingly, a low depth tray for bottles is provided which includes a first pair of opposed walls, a second pair of opposed walls attached to the first pair of opposed walls to form a wall structure, and a base attached to the wall structure. At least one interior column projects upwardly within the wall structure, where the interior column has a height less than the height of bottles loaded in the tray. A plurality of interior divider walls of double-walled construction project upwardly from the base and extend between the one or more columns and the wall structure to form an interior grid structure. Together, the divider walls, columns, base, and wall structure define a plurality of bottle retaining pockets, where each pocket includes at least one divider wall and is sized to receive a single bottle therein.

According to a preferred embodiment of the present invention, the tray is integrally molded of a plastic material. The wall structure has a double-walled construction and includes a lower wall portion having a substantially flat outer wall and a generally curved inner wall. The lower wall portion also includes a plurality of windows formed therein. In addition, the wall structure includes an upper wall portion having a plurality of upwardly projecting wall columns disposed between the windows. The wall columns and the one or more interior columns are substantially equal in height, and preferably extend a distance above the base of approximately one third of the height of bottles loaded in the tray. The wall columns and interior columns are substantially hollow, and include at least one curved surface contoured to the shape of bottles loaded in the tray. Likewise, the divider walls each include at least one curved surface contoured to the bottle shape. Furthermore, each column preferably includes an opening on the curved surface adjacent the base.

The interior columns are preferably substantially octagonal in shape, having four alternate sides with curved surfaces contoured to the shape of bottles loaded in the tray. Furthermore, the columns disposed along a transverse axis of the tray each include a transversely extending recess formed therein, preferably extending downwardly to the height of the outer wall structure.

Each of the second pair of opposed walls includes a handle including a cutout portion formed adjacent to the base and a slot formed above the cutout portion. With this handle configuration, a user's fingers can be inserted into the cutout portion and through the slot in a palm-up orientation, and into the slot and through the cutout portion in palm-down orientation.

The base includes an upper surface including a plurality of spaced bottle support areas, where each bottle support area forms part of a bottle retaining pocket. The bottle support areas each include a generally circular central portion and a concave perimeter portion which at least partially surrounds the central portion and is attached to at least one divider wall of the bottle retaining pocket. The bottle support areas also include apertures formed therein. In a preferred embodiment, the bottle retaining pockets are sized to receive two-liter bottles.

The base also includes a lower surface which includes generally circular, concave receiving areas having central retaining openings sized to receive bottle closures therein, where the receiving areas are operable to guide the bottle closures into the corresponding retaining openings. The concave receiving areas of the base lower surface are substantially aligned with the bottle support areas of the base upper surface, and the bottle retaining pockets within the tray have substantially equal center-to-center distances.

When the tray of the present invention is empty and is disposed in a stacked configuration with a like lower tray, the columns of the tray are adapted to receive at least a portion of the columns of the like lower tray and a lower surface of the outer wall structure of the tray is adapted to be supported on an upper surface of the wall structure of the like lower tray. When the tray of the present invention is loaded with bottles and is disposed in a stacked configuration with a like lower tray, the bottle retaining pockets of the tray are substantially aligned with the bottle retaining pockets of the like lower tray, and the receiving areas of the tray are adapted to receive the closures of bottles loaded in the like lower tray.

When the tray of the present invention is empty and is disposed in a cross-stacked configuration with an upper like tray, the column recesses are adapted to receive a portion of the wall structure of the upper like tray. When the tray of the present invention is loaded with bottles and is disposed in a cross-stacked configuration with an upper like tray, the bottle receiving pockets of the tray are aligned with the receiving areas of the upper like tray. In addition, the center-to-center distances between the bottle retaining pockets of the tray of the present invention and the bottle retaining pockets of an adjacent like tray abutting the wall structure are substantially equal.

The above objects and other objects, features, and advantages of the present invention are readily apparent from the following detailed description of the best mode for carrying out the invention when taken in connection with the accompanying drawings.

DETAILED DESCRIPTION OF THE PREFERRED EMBODIMENT(S)

Figure 1:
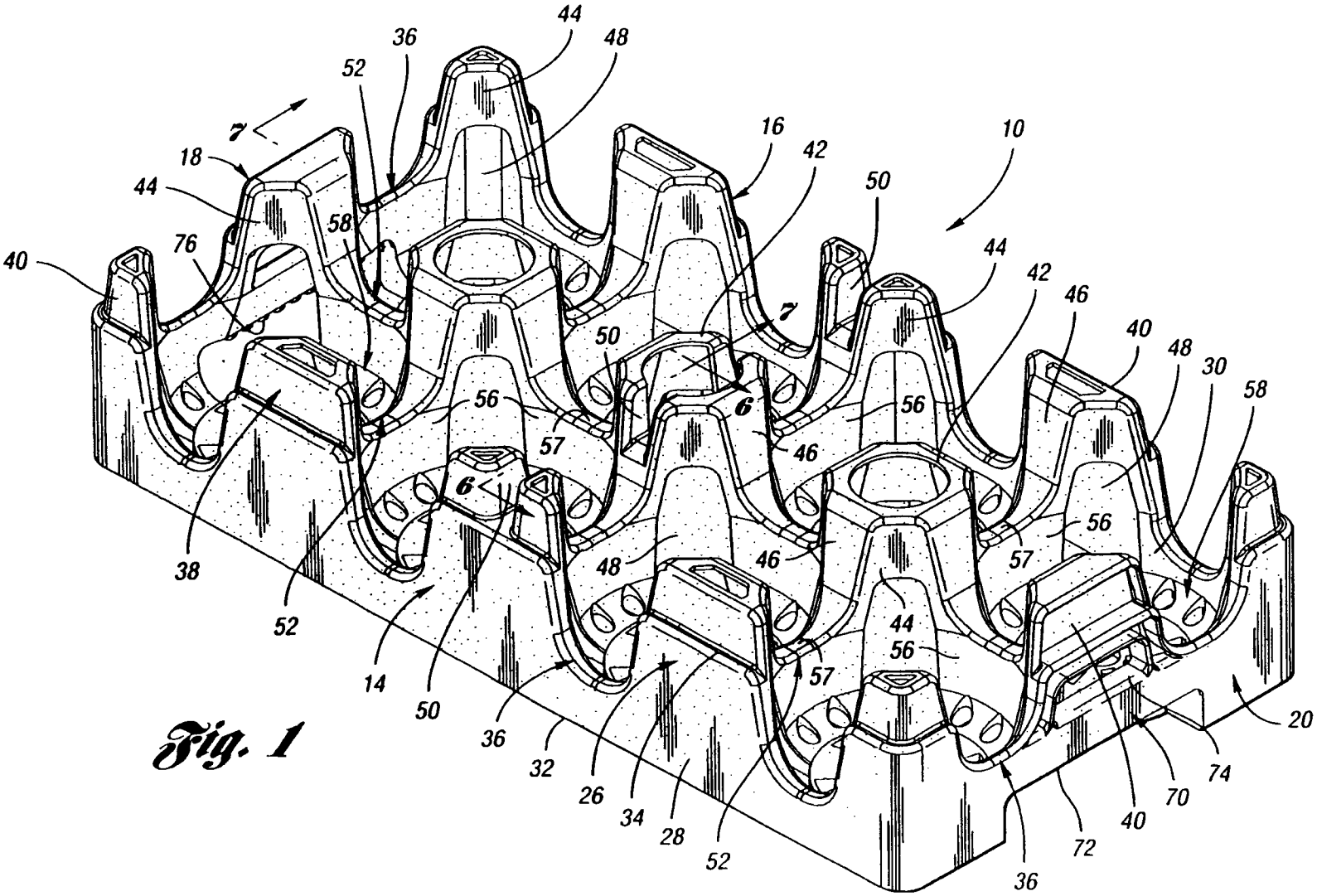
FIG. 1 is a perspective view of a stackable low depth tray according to the present invention.

FIGS. 1-5 show several views of a low depth tray 10 according to the present invention. While tray 10 is suited for many uses, tray 10 is particularly suitable for storing and transporting bottles B (see FIGS. 10, 13, and 15). Tray 10 includes a base 12 or floor member (best shown in FIGS. 2-3), a first pair of opposed walls 14, 16, and a second pair of opposed walls 18, 20. For convenience, and without additional limitation, first pair of opposed walls 14, 16 will be referred to herein as side walls, and second pair of opposed walls 18, 20 will be referred to herein as end walls. Side walls 14, 16 and end walls 18, 20 are attached to each other to form a wall structure, and are attached to base 12 and extend upwardly therefrom. Preferably, side walls 14, 16, end walls 18, 20, and base 12 form an integral, unitary member of one-piece construction. Tray 10 is generally symmetric about a longitudinal axis 22 and a transverse axis 24 thereof (see FIG. 2).

Tray 10 is typically formed of various types of plastic or polymeric materials, such as high density polyethylene (HDPE), by an injection molding or other plastic molding process suitable to this application. As is well understood in the art, the wall thickness of base 12, walls 14, 16, 18, 20, and other components illustrated and disclosed herein may vary depending on the intended usage and other characteristics desired from tray 10. In the embodiment shown herein, tray 10 is rectangular having side walls 14, 16 which are relatively longer than end walls 18, 20. However, tray 10 of the present invention is not limited to a rectangular shape and may include side walls 14, 16 and end walls 18, 20 of equal length forming a tray 10 of square dimensions.

Figure 2:
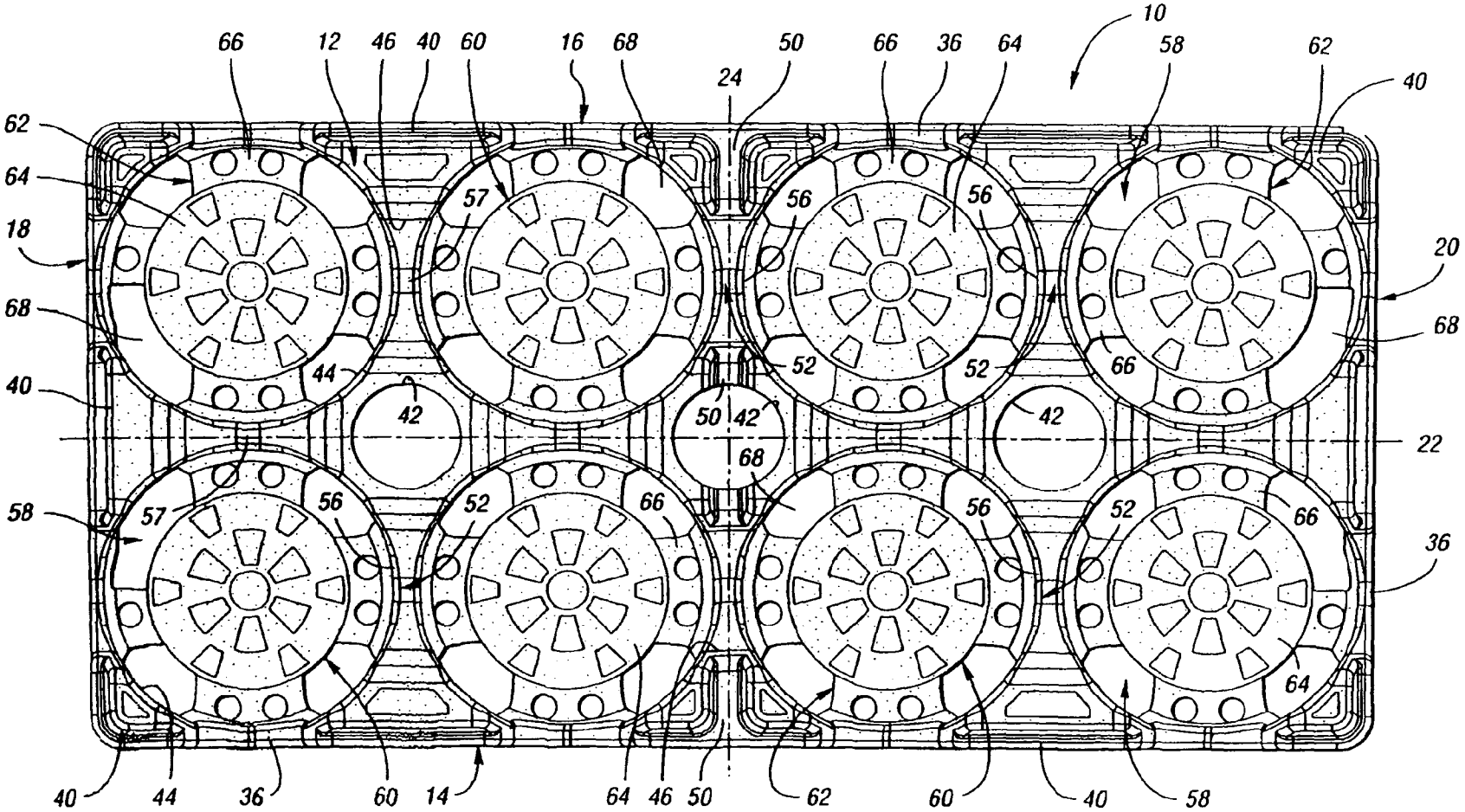
FIG. 2 is a top plan view of the tray.
Figure 10:
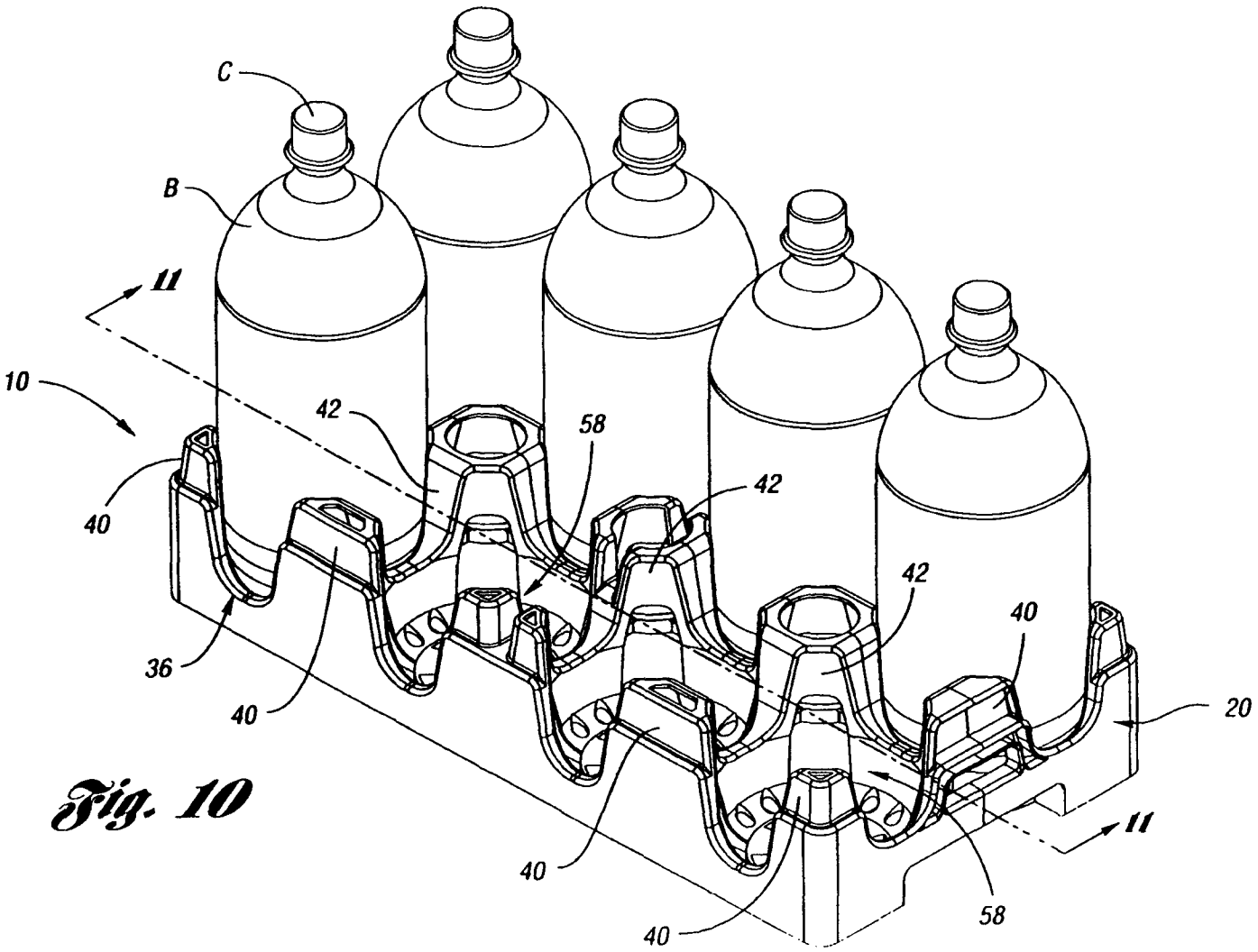
FIG. 10 is a perspective view of the tray shown loaded with several bottles.
Figure 11:
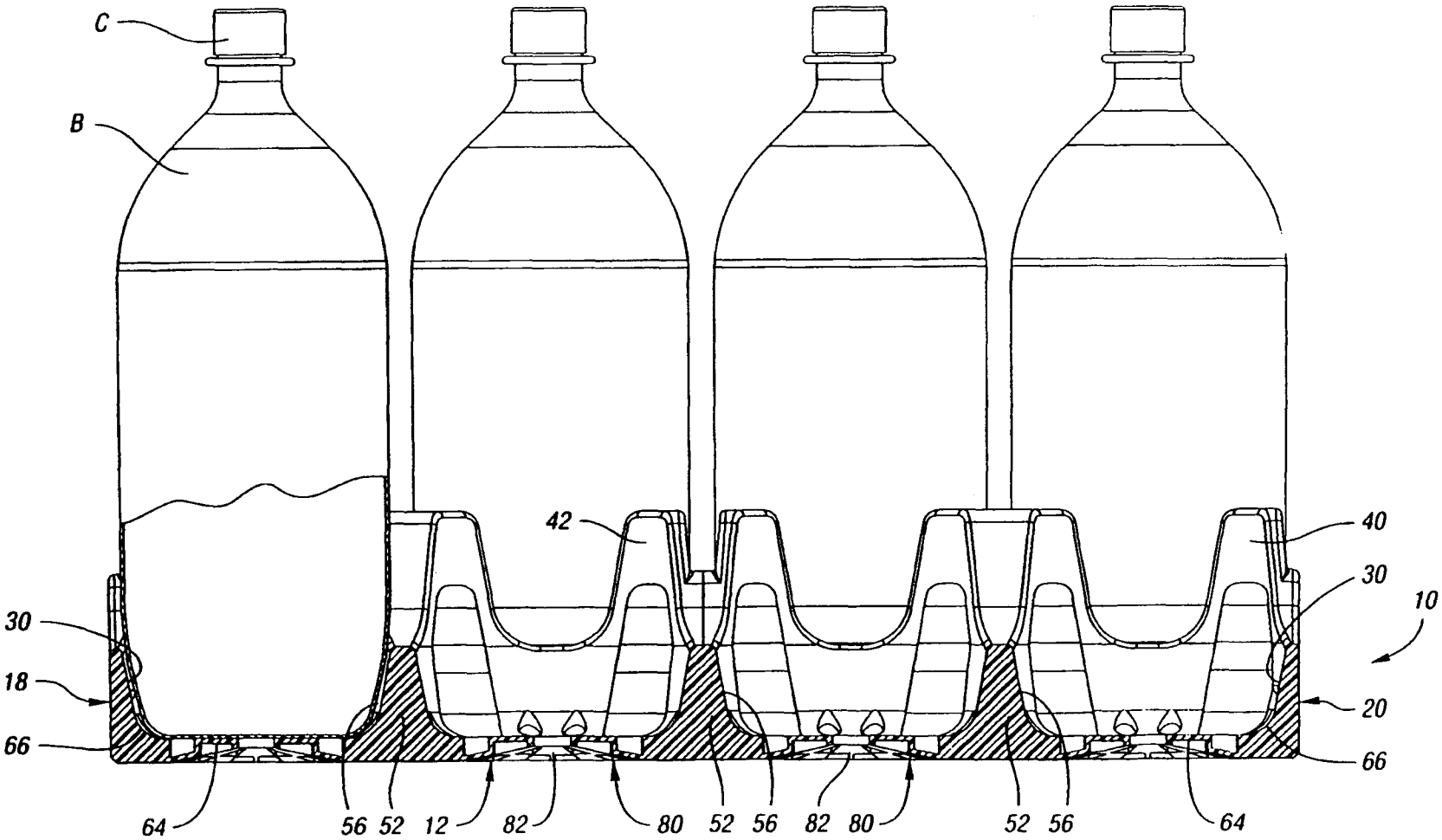
FIG. 11 is a cross-sectional view of the tray of FIG. 10 taken along line 11-11.
Figure 13:
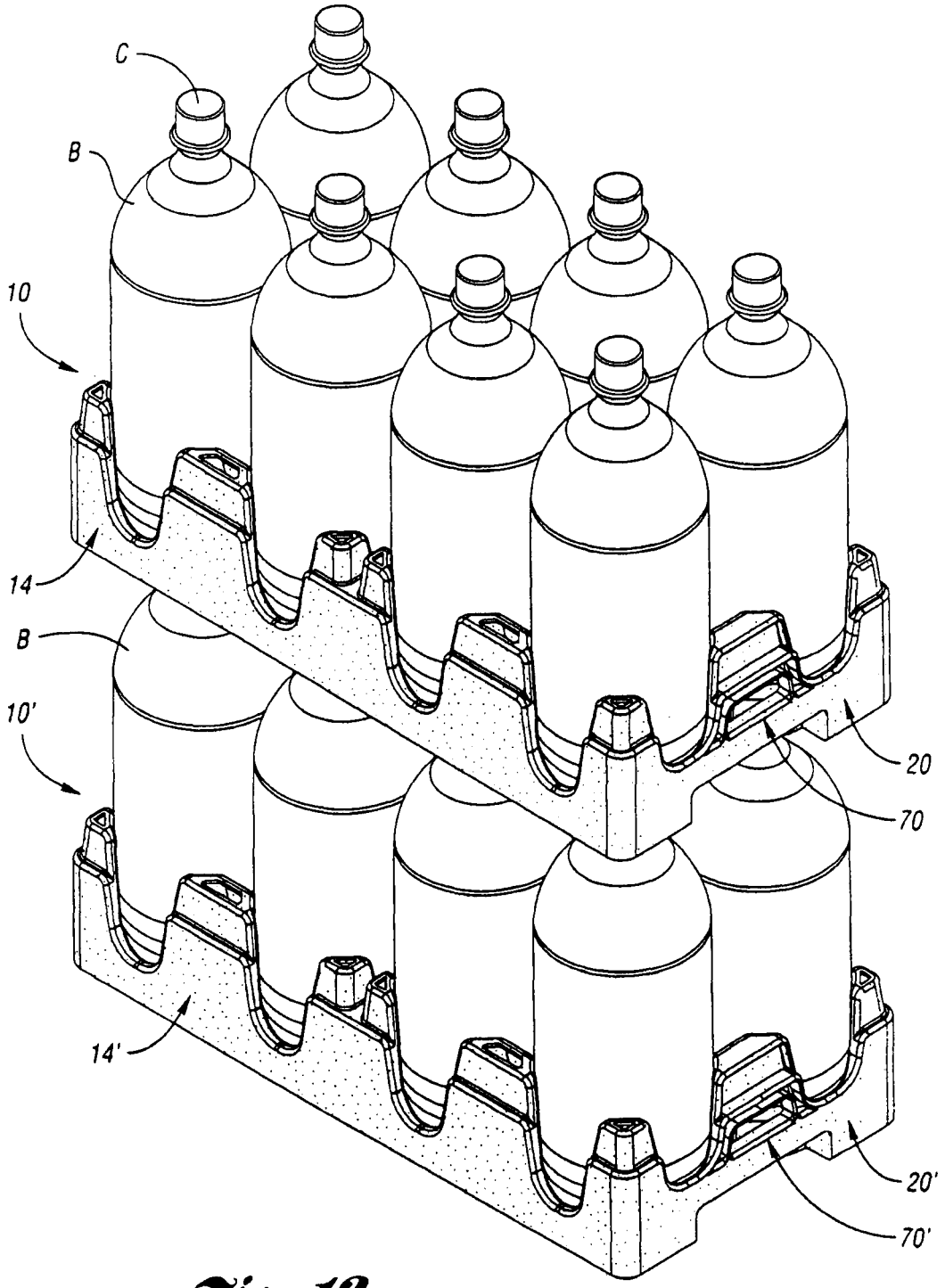
FIG. 13 is a perspective view of the tray loaded with bottles and disposed in a stacked configuration with a like loaded tray.

In a preferred embodiment, side walls 14, 16 and end walls 18, 20 have double-walled construction. The double wall construction of walls 14, 16, 18, 20 eliminates the variance in wall thickness, or draft, which can result during the molding of single thickness wall portions. Referring to FIGS. 1-2, side walls 14, 16 and end walls 18, 20 include a lower wall portion 26 having a substantially flat outer wall 28 and a generally curved inner wall 30 which is contoured to the shape of bottles loaded with tray 10 (see FIG. 11). Lower wall portion 26 further includes a lower surface 32 and an upper surface 34 which are employed during stacking and cross-stacking of trays 10 as described below with reference to FIGS. 8-9 and 14. As shown in FIG. 1 and in the side and end elevational views of FIGS. 4 and 5, respectively, lower wall portion 26 of side walls 14, 16 and end walls 18, 20 includes windows 36 formed therein which extend below the height of upper surface 34. Windows 36 are preferably generally semicircular, although other shapes are fully contemplated. As shown in FIGS. 10, 13, and 15, windows 36 allow for greater visibility of bottles B stored within tray 10, and also reduce the weight of tray 10.

Referring again to FIGS. 1 and 4-5, side walls 14, 16 and end walls 18, 20 further include an upper wall portion 38 having a plurality of wall columns 40 projecting upwardly between windows 36 and set inwardly from lower wall portion 26 to define upper surface 34. In addition, one or more upwardly projecting interior columns 42 are disposed away from side walls 14, 16 and end walls 18, 20 along the longitudinal axis 22 of tray 10. Preferably, wall columns 40 and interior columns 42 are all substantially equal in height and extend a distance above base 12 of approximately one third of the height of bottles B loaded in tray 10 (see FIG. 10). For example, when tray 10 is designed to retain two-liter bottles, columns 40, 42 extend upwardly approximately 4 inches from base 12. In this way, columns 40, 42 provide a stabilizing structure which still maintains high bottle visibility and reduces manufacturing costs.

Columns 40, 42 are substantially hollow for reduced tray weight and also to permit empty trays 10 to stack and cross-stack as described below with reference to FIGS. 8-9 and 14. Columns 40, 42 each include at least one curved surface 44 contoured to the shape of bottles loaded in the tray. Interior columns 42 are preferably substantially octagonal in shape, having alternating curved surfaces 44 and flat surfaces 46. Wall columns 40 disposed in the corners between two adjacent walls 14, 16, 18, 20 have one curved surface 44, while wall columns 40 disposed on side walls 14, 16 or end walls 18, 20 have two curved surfaces 44 and one flat surface 46 disposed therebetween. Furthermore, each column 40, 42 preferably includes an opening 48 on the curved surfaces 44 thereof adjacent base 12, again for reducing the weight of tray 10.

Figure 4:
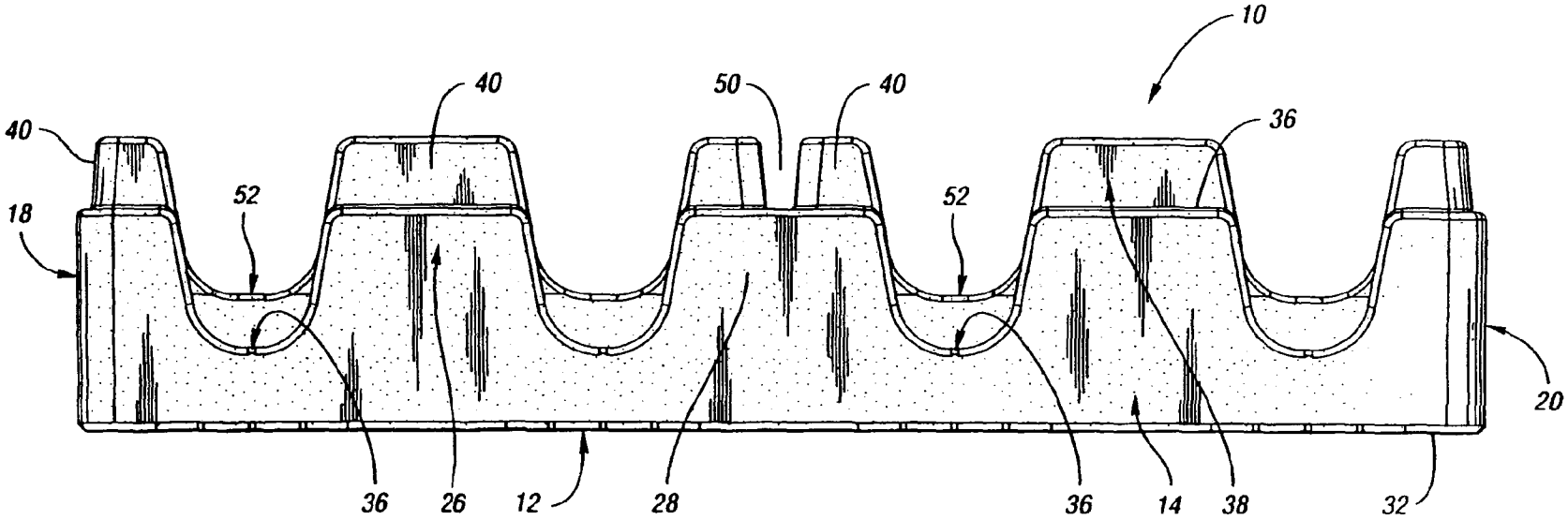
FIG. 4 is a front side elevational view of the tray, the rear side being a mirror image thereof.

Referring now to FIGS. 1-2 and 4, columns 40, 42 disposed along transverse axis 24 of tray 10 each include a recess 50 formed therein which extends along transverse axis 24. Recesses 50 preferably extend downwardly to the height of upper surface 34 of lower wall portion 26, and allow for cross-stacking of empty trays 10, as described below with reference to FIG. 14.

Figure 6:
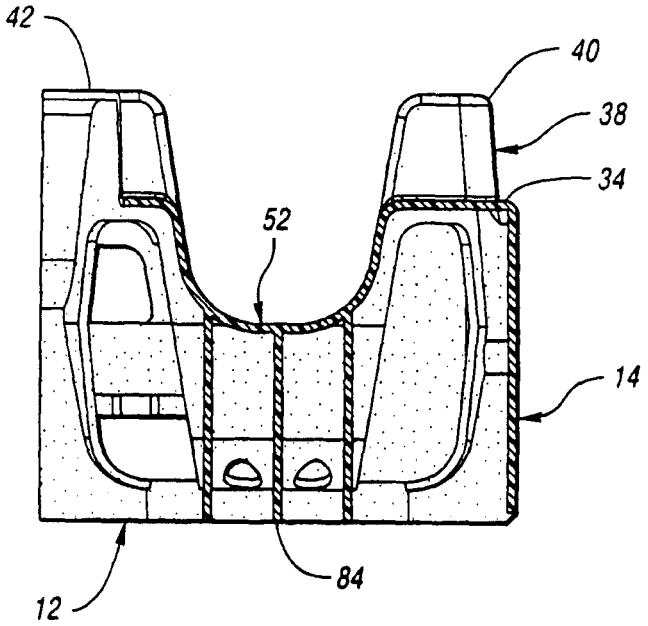
FIG. 6 is a cross-sectional view of the tray taken along line 6-6 of FIG. 1.
Figure 7:
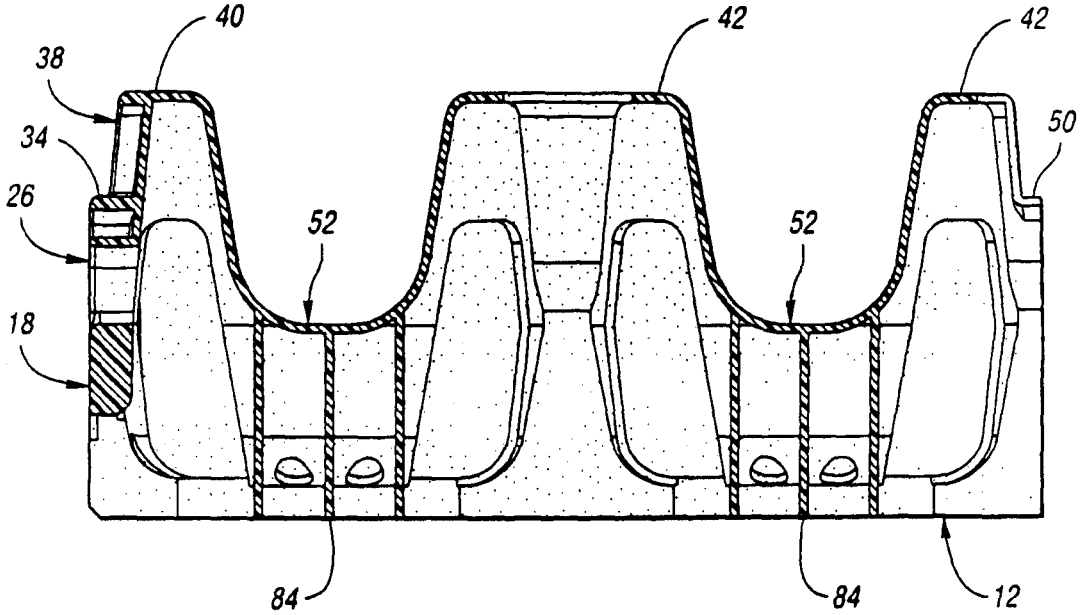
FIG. 7 is a cross-sectional view of the tray taken along line 7-7 of FIG. 1.
Figure 12:
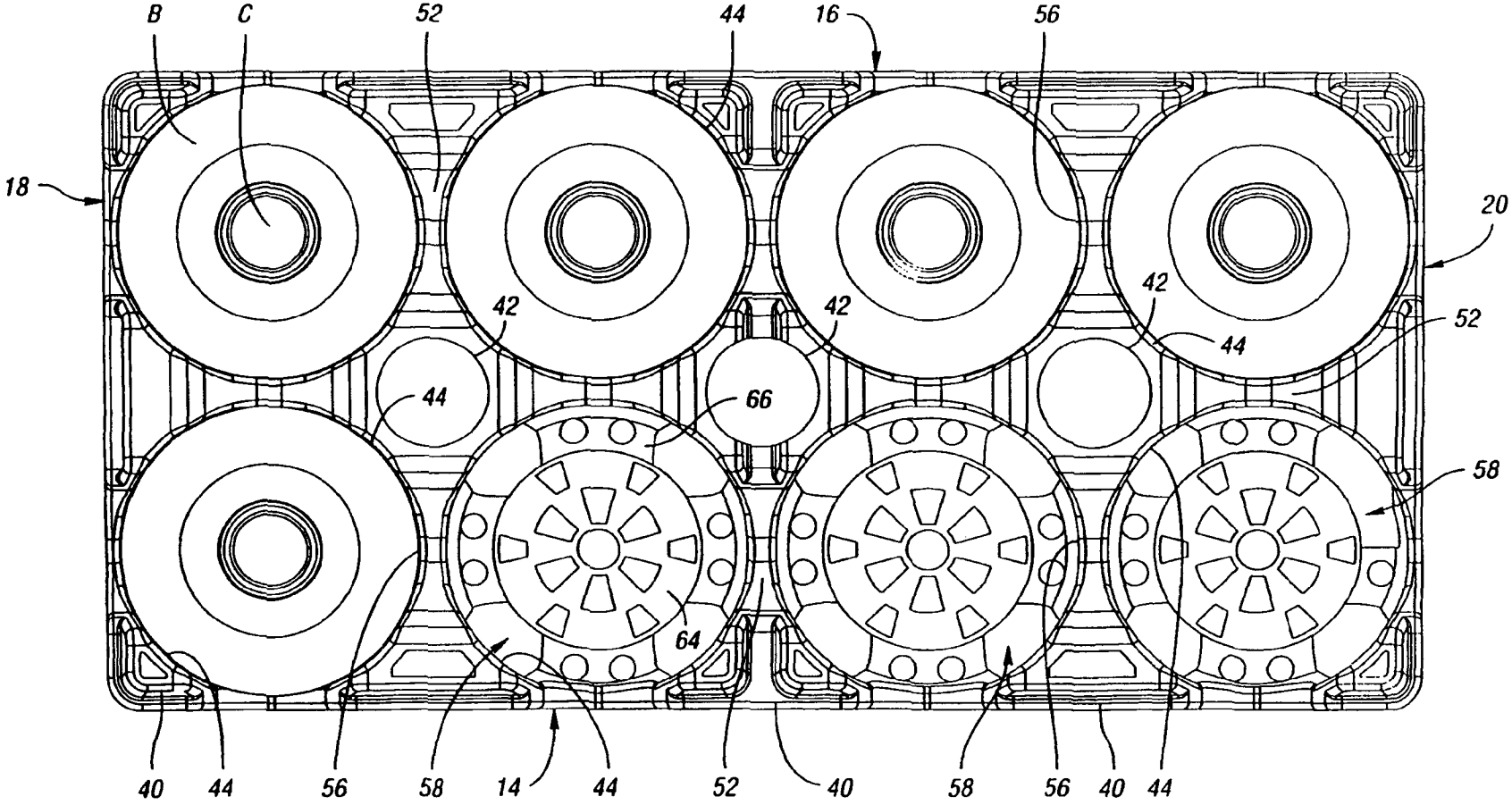
FIG. 12 is a top plan view of the tray of FIG. 10.

Still further, as best shown in FIGS. 1 and 4 and the cross-sectional views of FIGS. 6-7, tray 10 includes a plurality of interior divider walls 52 of double-walled construction which project upwardly from base 12 and extend between adjacent columns 40, 42 to form an interior grid structure. Tray 10 is constructed such that divider walls 52 are continuous with columns 40, 42 and secure columns 40, 42 to base 12. The continuous double-walled construction of tray 10 provides a lighter tray having greater strength and stiffness, which can also be more quickly, easily, and less expensively molded. Divider walls 52 are lower in height than columns 40, 42 and include curved surfaces 56 which are contoured to the shape of bottles B loaded in tray 10, surfaces 56 being connected by a top surface 57 (see FIGS. 10-12).

Together, divider walls 52, columns 40, 42, base 12, side walls 14, 16, and end walls 18, 20 define a plurality of bottle retaining pockets 58, where each pocket 58 includes at least one column 40, 42 and at least one divider wall 52 and is sized to receive a single bottle therein. In greater specificity, the four curved surfaces 44 of each interior column 42 define portions of four bottle retaining pockets 58 and the four flat surfaces 46 separate these pockets 58 and are generally attached to an have a centerline coplanar with that of divider walls 52. The two curved surfaces 44 of each wall column 40 help define two separate and adjacent bottle retaining pockets 58, with the flat surface disposed between these two bottle retaining pockets 58. Lastly, the single curved surface 44 of wall columns 40 disposed in the corners of tray 10 belong to only one bottle retaining pocket 58. As such, four curved surfaces 44 on four separate columns 40, 42 form the four corners of a bottle retaining pocket 58.

The ratio of the length of side walls 14, 16 to the length of end walls 18, 20 is substantially equal to the ratio of the number of bottle retaining pockets 58 in the lengthwise direction to the number of bottle retaining pockets 58 in the widthwise direction. For example, the 8-bottle tray 10 depicted herein is twice as long as it is wide and holds bottles in a 4×2 relationship. In addition, bottle retaining pockets 58 of tray 10 are sized to receive two-liter bottles, as shown in FIGS. 10-13 and 15. Of course, tray 10 according to the present invention can be designed to retain any number of bottles and any size of bottles.

Referring now to the top plan view of FIG. 2, base 12 includes an upper surface 60 including a plurality of spaced bottle support areas 62, where each bottle support area 62 forms part of one bottle retaining pocket 58. Bottle support areas 62 each include a generally circular central portion 64 and a concave perimeter portion 66 which at least partially surrounds the central portion 64. Central portion 64 is preferably substantially flat to permit retention of bottles regardless of the configuration of the bottom of the bottles, and to permit rotation of bottles of all types within bottle retaining pockets 58 to facilitate display of the product through windows 36. Alternatively, central portion 64 can be formed with small depressions or projections (not shown) corresponding to the locations and configurations of the bottoms of the bottles to be retained within each of the bottle receiving pockets 58.

Perimeter portion 66 is contoured to the bottle shape (see FIG. 11) and is continuous with the side walls 14, 16, end walls 18, 20, and divider walls 52 included in each bottle retaining pocket 58. The contoured bottle retaining pockets 58 of tray 10 of the present invention provide greater support and stability for the bottles B loaded in tray 10, such that excess movement of the bottles is avoided in order to ensure that the bottles remain in a vertically upright position to most advantageously bear the load of bottles stacked or cross-stacked above. As best shown in FIG. 2, bottle support areas 62 preferably have a configuration with a plurality of apertures 68 formed therein. These apertures 68 provide a lightweight tray, and are practical for allowing any liquids to drain through base 12. Of course, bottle support areas 62 could include any design suitable for supporting bottles.

Figure 5:
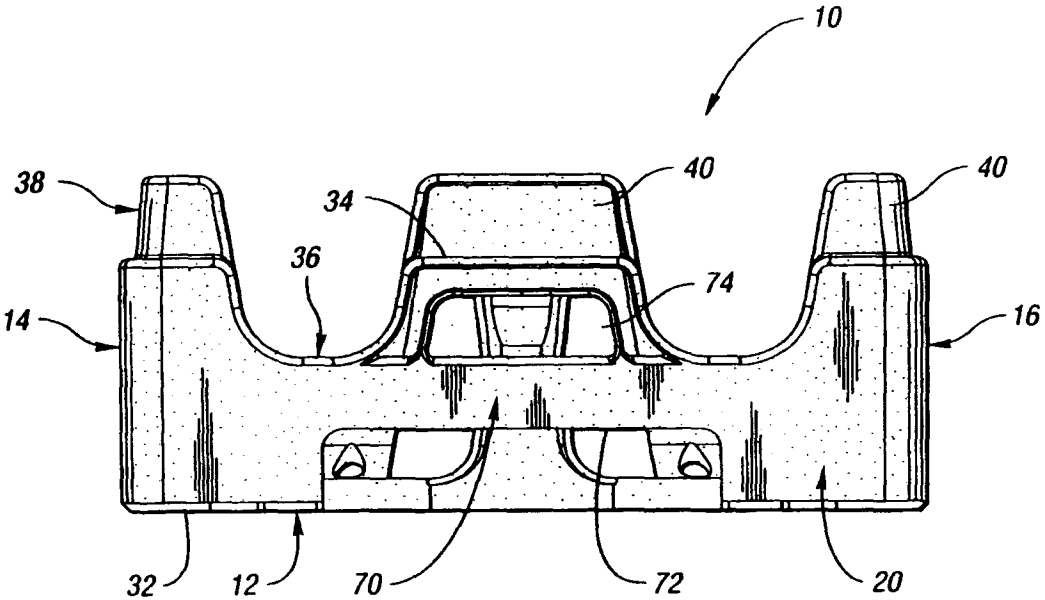
FIG. 5 is a right end elevational view of the tray, the left end being a mirror image thereof.

Referring now to FIGS. 1 and 5, end walls 18, 20 each include a handle 70 formed therein to facilitate carrying tray 10. In the preferred embodiment shown, handles 70 include a cutout portion 72 formed adjacent to base 12 and a slot 74 formed above cutout portion 72, wherein the area immediately interior to cutout portion 72 and slot 74 is hollow in order to ensure sufficient hand clearance. With this handle configuration, a user's fingers can be inserted into cutout portion 72 and through slot 74 in a palm-up orientation, or into slot 74 and through cutout portion 72 in palm-down orientation. As yet another alternative, a user could insert his/her fingers into slot 74 in a palm-up orientation. For example, the palm-up orientation may be preferred when tray 10 is on the ground, while the palm-down orientation may be preferred when tray 10 is stacked above an operator's head. Providing an operator with the option of handling tray 10 in either hand orientation enables easier manipulation of tray 10. The importance of this feature can be appreciated when tray 10 is loaded with bottles B, as shown in FIGS. 13 and 15. Advantageously, handle 70 does not increase the overall footprint of tray 10.

In addition to handles 70 provided on end walls 18, 20, handles 70 or an alternate handle configuration may be provided on side walls 14, 16 such that a gripping structure is disposed on each side of tray 10 for removing cross-stacked trays 10 from a pallet, since some of the cross-stacked trays 10 will have end walls 18, 20 facing the operator and some of the cross-stacked trays 10 will have side walls 14, 16 facing the operator (see FIG. 15). Handles 70 may also have finger recesses 76 along the upper edge and/or lower edge, as shown in FIGS. 1 and 3, to further aid in carrying tray 10.

Figure 3:
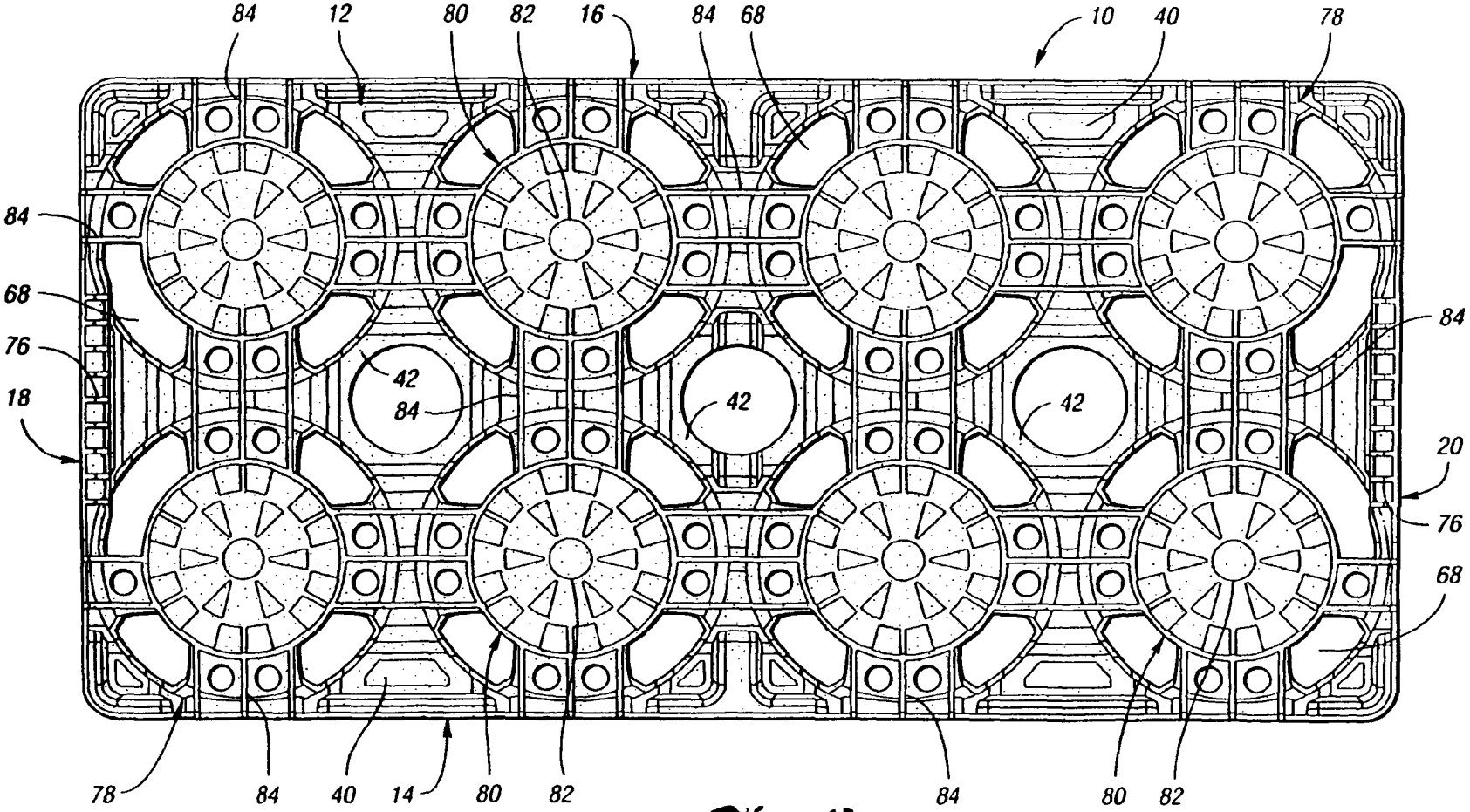
FIG. 3 is a bottom plan view of the tray.

Turning next to the bottom plan view of FIG. 3, base 12 also includes a lower surface 78 which includes receiving areas 80 having central retaining openings 82 sized to receive bottle closures therein of bottles disposed therebelow. Receiving areas 80 are preferably recessed and concave (see FIG. 11) and generally circular, and are operable to guide the closures C of bottles B in a lower tray into the corresponding retaining openings 82 to retain loaded trays 10 in a stacked (FIG. 13) or cross-stacked (FIG. 16) arrangement. More specifically, when tray 10 is being positioned on a like lower tray, often the bottle closures C will not precisely line up with the respective central openings 82. However, the bottle closures C will contact receiving areas 80 which, because of their concave shape, will guide the bottle closures C into central retaining openings 82. Base lower surface 78 preferably further includes ribs 84 connecting receiving areas 80 to each other and to side walls 14, 16 and end walls 18, 20. Ribs 84 allow bottle closures C to slide easily along lower surface 78 between receiving areas 80. Therefore, once the bottle closures are disengaged from receiving areas 80, tray 10 may slide along the bottle closures in a similar lower tray to facilitate handling.

Receiving areas 80 of base lower surface 78 are substantially aligned with bottle support areas 62 of base upper surface 60, and correspond in number to the number of bottles that tray 10 is designed to retain. Furthermore, bottle retaining pockets 58 within tray 10 have substantially equal center-to-center distances, and the center-to-center distances between adjacent bottle retaining pockets 58 in adjacent trays 10 with abutting side walls are substantially equal.

Figure 8:
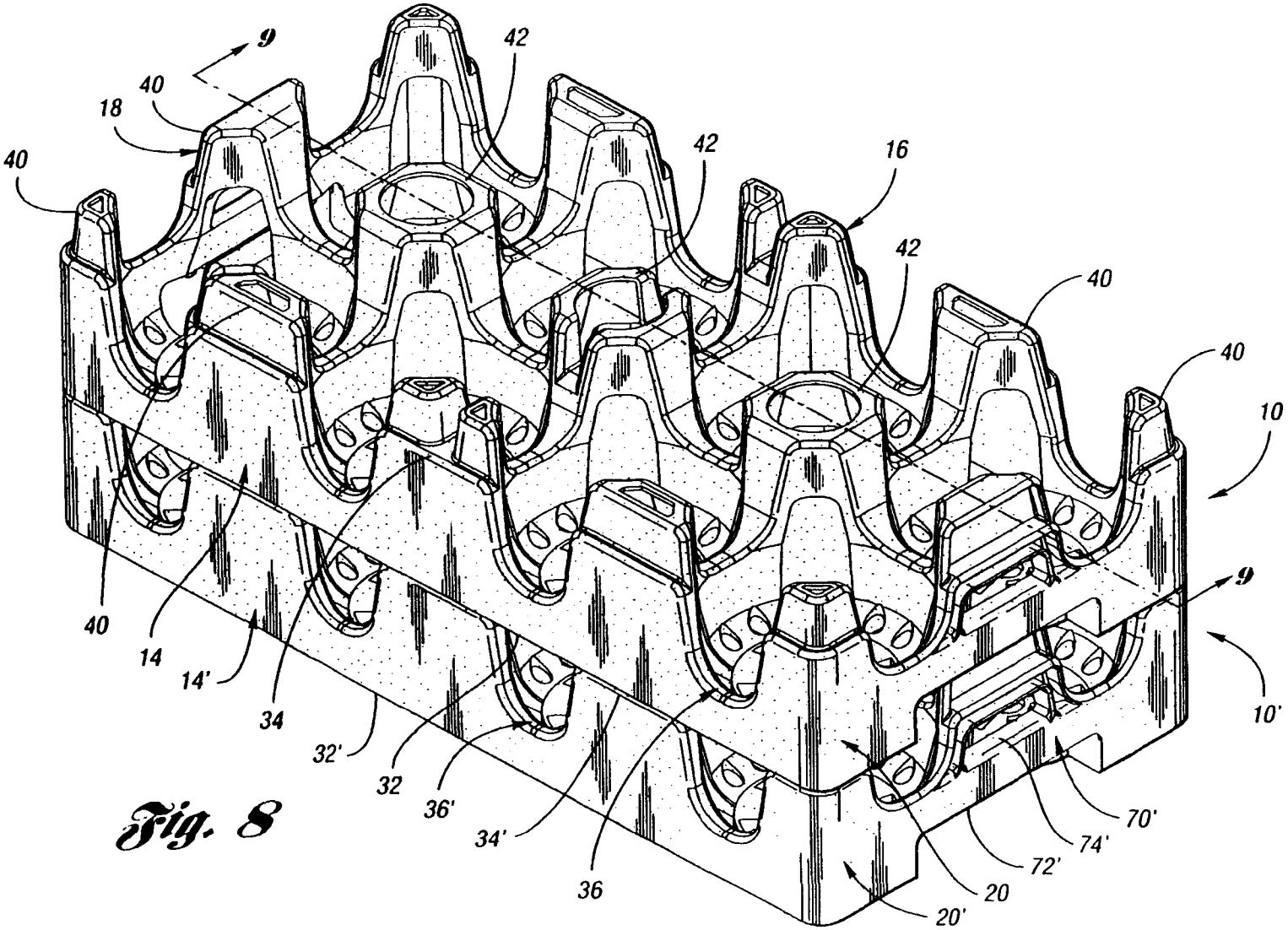
FIG. 8 is a perspective view of the tray of FIG. 1 disposed in a stacked configuration with a like tray.
Figure 9:
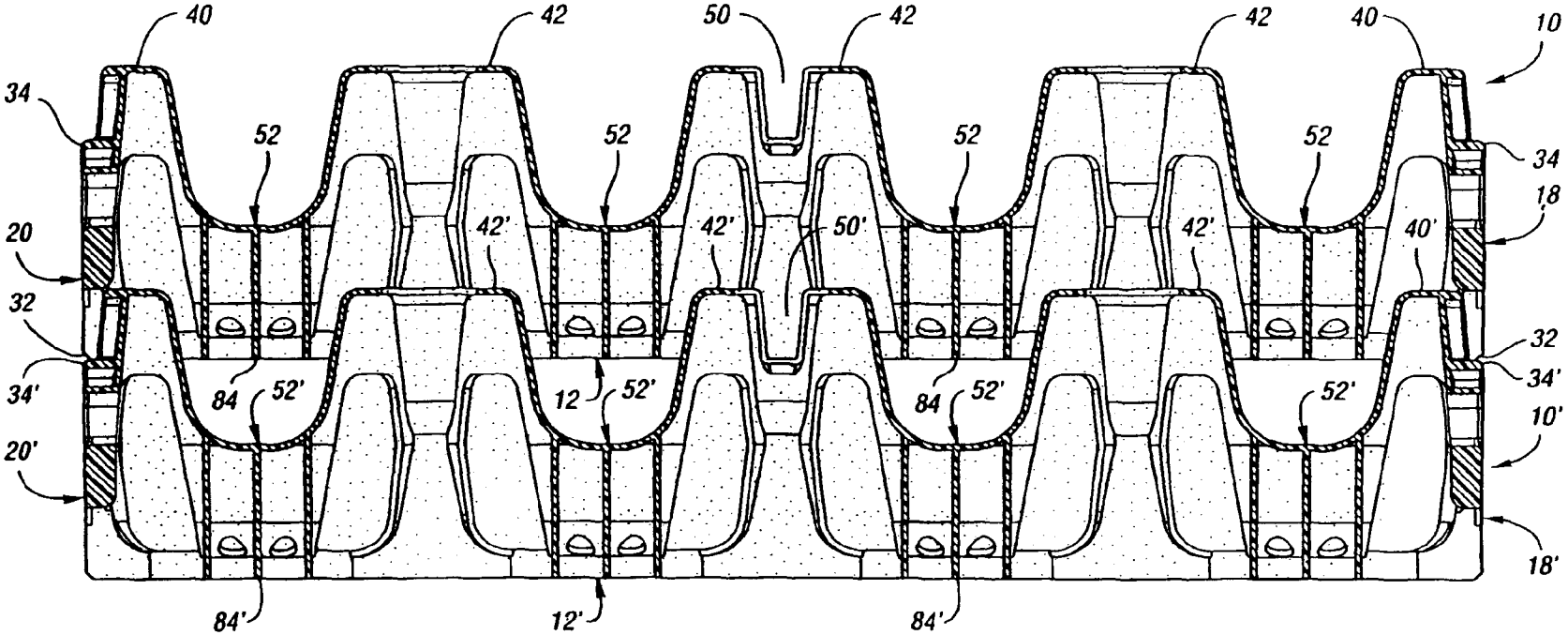
FIG. 9 is a cross-sectional view of the trays of FIG. 8 taken along line 9-9.

As shown in the perspective view of FIG. 8 and the cross-sectional view of FIG. 9, empty trays 10 may be securely stacked on top of each other. In FIGS. 8-9 and subsequent figures, elements of lower like tray or trays 10' are given like reference numerals to corresponding elements in upper tray or trays 10 except for the addition of a prime (') designation. When upper tray 10 is empty and is disposed in a stacked configuration with like lower tray 10', the substantially hollow columns 40, 42 of upper tray 10 are adapted to receive at least a portion of respective columns 40', 42' of like lower tray 10'. In addition, lower surface 32 of side walls 14, 16 and end walls 18, 20 is adapted to be supported on upper surface 34' of lower side wall portion 26' of like lower tray 10'.

Turning now to FIG. 13, upper tray 10 is shown loaded with bottles B and disposed in a stacked configuration with like lower tray 10'. As shown, bottle retaining pockets 58 of upper tray 10 are substantially aligned with bottle retaining pockets 58' of like lower tray 10', such that the bottles B are coaxially aligned with each other.

Figure 14:
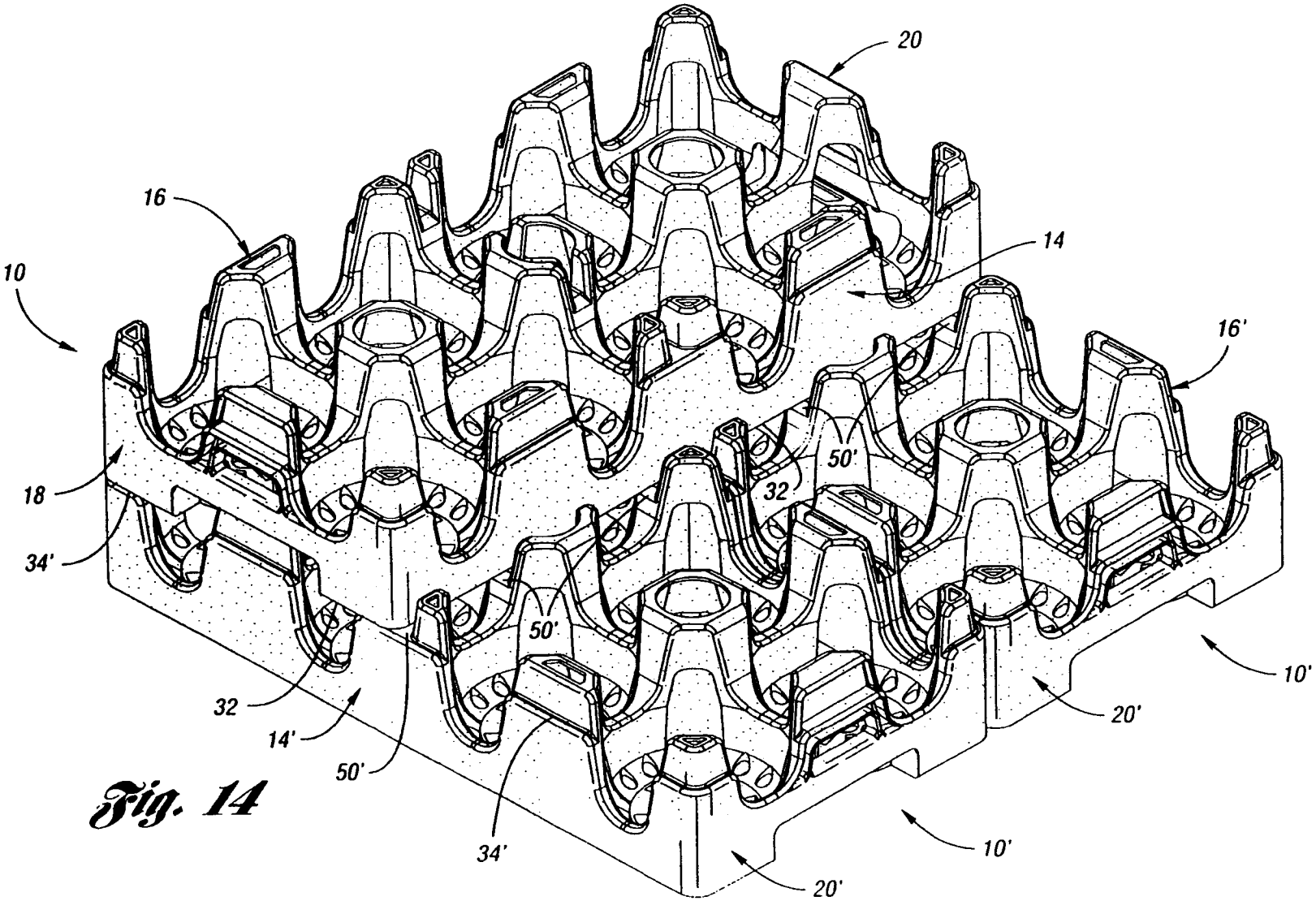
FIG. 14 is a perspective view of two lower trays disposed in a cross-stacked configuration with a like upper tray.
Figure 15:
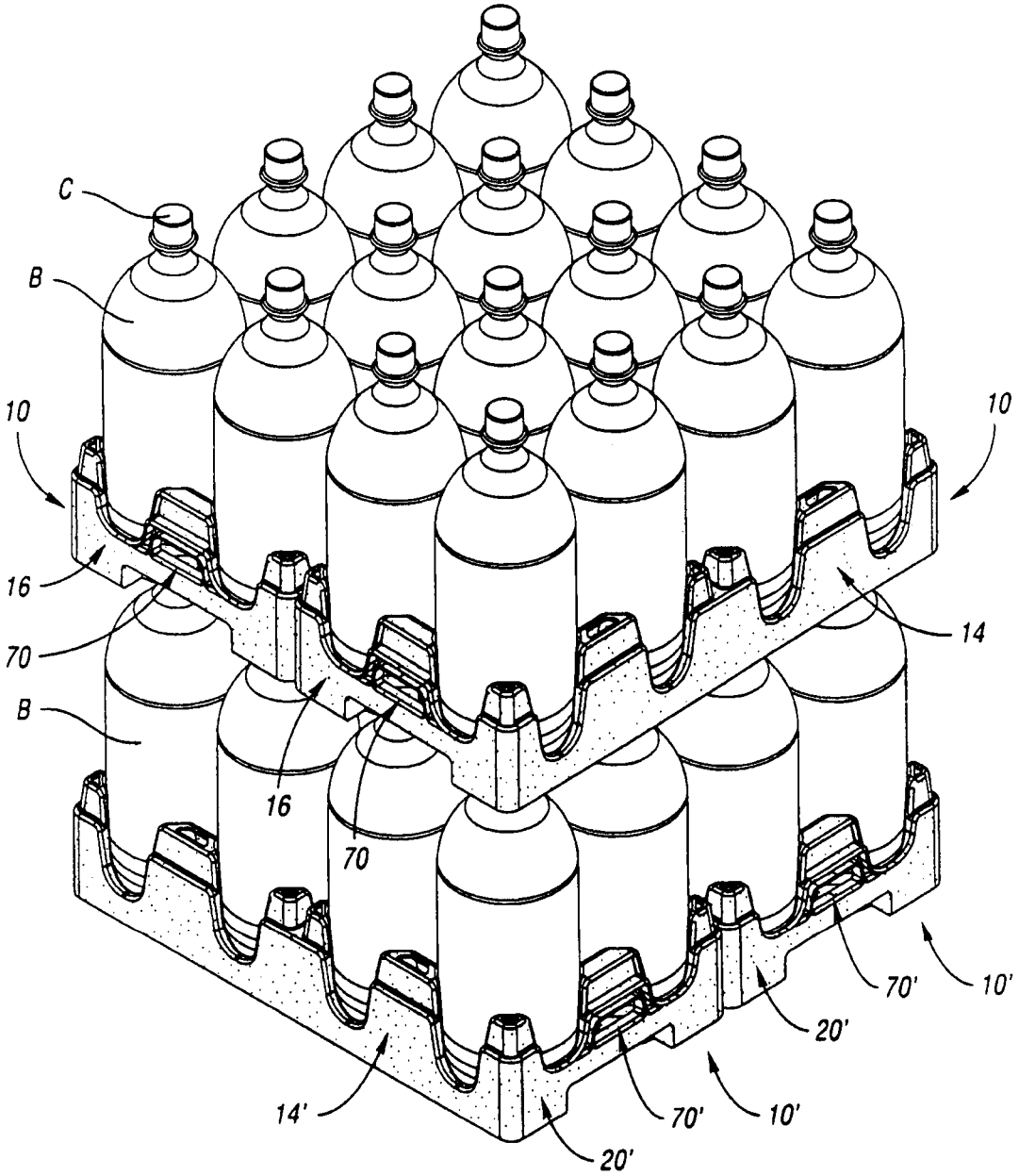
FIG. 15 is a perspective view of two loaded trays disposed in a cross-stacked configuration with two upper like loaded trays.

As an alternative to stacking, cross-stacking of trays is done by rotating a top tray 90 degrees about a vertical axis and lowering it onto a lower tray or trays (see FIG. 14). Cross-stacking is often used to improve the stability of trays of bottles loaded on a warehouse pallet. In a cross-stacked structure, each layer has trays oriented parallel to each other with the trays in adjacent layers being oriented at right angles to each other. Since each tray in the cross-stacked layer rests on at least two trays in the layer below, the trays of the cross-stacked layer tend to keep the trays on which they rest from moving apart from each other, thereby stabilizing the structure.

With reference to FIG. 14, when upper tray 10 is empty and is disposed in a cross-stacked configuration with lower like trays 10', column recesses 50' of lower like trays 10' are adapted to receive a portion of the wall structure of the upper tray 10, which in the example depicted is side wall 14. In addition, lower surface 32 of side wall 16 and end walls 18, 20 are supported on upper surface 34' of lower side wall portions 26' of lower trays 10'. When disposed in cross-stacked configuration shown in FIG. 14, at least a portion of hollow columns 40', 42' of trays 10' are adapted to be received within respective columns 40, 42 of upper tray 10.

Lastly, referring to FIG. 15, when trays 10 of the present invention are loaded with bottles B and are disposed in a cross-stacked configuration with lower like trays 10', bottle retaining pockets 58 of trays 10 are substantially aligned with bottle retaining pockets 58' of trays 10', such that the bottles B are coaxially aligned with each other. This is due to the substantially equal center-to-center distances between the bottle retaining pockets 58 of adjacent like trays 10 having abutting side walls 14, 16 or end walls 18, 20.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A low depth tray for bottles comprising:

a base;

at least one interior column projecting upwardly from the base;

a plurality of interior divider structures which project upwardly from the base, wherein each of the plurality of interior divider structures extends from the at least one interior column, and each of the plurality of interior divider structures includes a first pocket side spaced apart from a second pocket side and having an area void of material therebetween; and an exterior wall structure directly attached to the base, wherein the exterior wall structure extends continuously around a perimeter of the tray;

a plurality of external columns, wherein the base is attached to the plurality of external columns, and the plurality of interior divider structure, the at least one interior column, the base, and the plurality of external columns define a plurality of bottle retaining pockets, wherein the plurality of external columns define the exterior wall structure having a first pair of opposed walls and a second pair of opposed walls connected to the first pair of opposed walls, wherein the at least one interior column projects upwardly from the base within the exterior wall structure, wherein each of the second pair of opposed walls includes a handle having a cutout portion formed adjacent to the base and a slot formed above the cutout portion, and a user's fingers can be inserted into the cutout portion and through the slot in a palm-up orientation and into the slot and through the cutout portion in a palm-down orientation.

2. A low depth tray for storing and transporting bottles comprising:

a floor member;

a plurality of external columns extending upwardly from the floor member, wherein a window is defined between two of the plurality of external columns wherein the plurality of external columns define the exterior wall structure having a double-walled construction and including a lower wall portion having a substantially flat outer wall and generally contoured inner wall adjacent the window which in adapted to contact the bottle received in each of the plurality of bottle retaining pockets;

an interior grid structure disposed within the plurality of external columns and connected thereto, wherein the interior grid structure includes a plurality of first divider walls and a plurality of second divider walls both extending upwardly from the floor member and a plurality of spaced interior columns projecting upwardly from the floor member, and an exterior wall structure directly attached to the floor member wherein the exterior wall structure extends continuously around a perimeter of the tray, wherein the exterior wall structure includes two handles on opposite ends thereof, each of the two handles having a cutout portion formed in the exterior wall structure adjacent the floor member and a slot formed in the exterior wall structure above the cutout portion, and a user's fingers can be inserted into the cutout portion and through the slot in a palm-up orientation and into the slot and through the cutout portion in a palm-down orientation;

wherein each of the plurality of first divider walls includes two spaced apart, generally parallel surfaces having an area void of material therebetween and extends between a first interior column and a second interior column, and wherein each of the plurality of second divider walls includes two spaced apart, generally parallel surfaces having an area void of material therebetween and extends between one of the plurality of spaced interior columns and one of the plurality of external columns, and wherein the interior grid structure, the plurality of external columns, and the floor member together define a plurality of bottle retaining pockets, and the plurality of external columns and the plurality of spaced interior columns each include at least one contoured surface adapted to contact a bottle received in each of the plurality of bottle retaining pockets.

* * * * *